US006059124A

United States Patent [19]

Weck et al.

[11] Patent Number: 6,059,124

[45] Date of Patent: May 9, 2000

[54] POINT OF PURCHASE DISPLAY SYSTEM AND DEVICE

[75] Inventors: David Weck, 1550 Bay Dr., Miami Beach, Fla. 33141; Erwin M. Frey, Fort Lauderdale, Fla.

[73] Assignee: David Weck, Miami Beach, Fla.

[21] Appl. No.: 09/036,787

[22] Filed: Mar. 9, 1998

[51] Int. Cl.[7] ..... A47F 5/00

[52] U.S. Cl. ..... 211/57.1; 211/59.1; 40/642.01

[58] Field of Search ..... 211/57.1, 59.1, 211/59.4, 106; 248/220.22, 220.31, 220.41, 220.42, 220.43; 40/642.01, 638, 651, 661.03, 661

[56] References Cited

U.S. PATENT DOCUMENTS

| | | | |
|---|---|---|---|
| 4,072,246 | 2/1978 | Paulin | 211/57.1 X |
| 4,112,603 | 9/1978 | Giulie | 40/638 |
| 4,405,051 | 9/1983 | Thalenfeld . | |
| 4,474,351 | 10/1984 | Thalenfeld . | |
| 4,520,978 | 6/1985 | Taub | 211/57.1 X |
| 4,540,093 | 9/1985 | Merl et al. . | |
| 4,674,721 | 6/1987 | Thalenfeld . | |
| 4,718,626 | 1/1988 | Thalenfeld et al. . | |
| 4,723,663 | 2/1988 | Learn | 248/220.42 X |
| 4,805,861 | 2/1989 | Thalenfeld et al. . | |
| 4,815,610 | 3/1989 | Borick et al. . | |
| 4,869,376 | 9/1989 | Valiulis et al. . | |
| 5,112,014 | 5/1992 | Nichols | 248/220.42 |
| 5,236,163 | 8/1993 | Valiulis | 211/59.1 X |
| 5,348,167 | 9/1994 | Jensen | 211/59.1 X |
| 5,439,120 | 8/1995 | Brozak . | |
| 5,499,722 | 3/1996 | Goldring . | |
| 5,671,851 | 9/1997 | Johnson et al. . | |
| 5,755,323 | 5/1998 | Zahn et al. | 211/59.1 X |
| 5,826,359 | 10/1998 | Thalenfield et al. | 211/59.1 X |
| 5,860,238 | 1/1999 | Anderson | 40/638 X |
| 5,860,239 | 1/1999 | Thalenfield et al. | 211/59.1 X |

*Primary Examiner*—Daniel P. Stodola

*Attorney, Agent, or Firm*—Lowe, Hauptman, Gopstein, Gilman & Berner, LLP

[57] ABSTRACT

A point of purchase system carrying consumer articles that are for sale and displaying information about the articles comprises a vertically extending mounting structure mounting plural point of purchase devices. Each device includes plural elongated elements extending generally parallel to each other. The elements receive and carry plural hanger mechanisms and articles associated therewith. Each element is mounted on the mounting structure so the elements extend generally at right angles from the mounting structure. Adjacent pairs of the elements are connected to each other so the adjacent pairs of the elements are horizontally spaced in approximately the same plane from each other by a distance determined by the spacing of receptacles for the elements on the mounting structure. The adjacent elements together carry a placard spanning the distance between the adjacent elements. The placard is at ends of the adjacent elements removed from the mounting structure and farther from the mounting structure than the articles carried by the elements. The placard has indicia about one of the articles on the mounting structure and a sample of the article and is located in such a manner that the indicia and sample article are clearly visible without obstructions to purchasers.

19 Claims, 4 Drawing Sheets

POINT OF PURCHASE DISPLAY SYSTEM AND DEVICE

FIELD OF INVENTION

The present invention relates generally to point of purchase display systems and devices and more particularly to a point of purchase display system and device wherein a placard carrying a sample article that is the same as the article for sale and indicia about the article is mounted at the forward end of an elongated member carrying the article for sale.

BACKGROUND ART

One common extensively used point of purchase display system includes a device comprising an elongated member extending from a vertical load bearing mounting surface. The elongated member is frequently in the form of a hook comprising a metal rod including upper and lower legs and a bridge connecting the legs together. The bridge is frictionally mounted in a bracket carried by the bearing mounting surface, typically either an apertured board (known as a pegboard) or a slotted wall for receiving fingers or flanges of the bracket. An article to be sold, for example, nails, screws, tacks, picture hangers and picture hanger accessories, is usually in a container, behind a transparent molded plastic window so the article is sealed in place on a backing card including an opening functioning as a hanger adapted to fit on the lower leg. Indicia about the article are carried on a placard attached to a tab at an end of the upper leg remote from the board. The indicia typically indicate the price of and features about the article.

While this prior art structure has been very successful in selling the articles, it occupies a significant amount of valuable wall space due, to a certain extent, to the large size of the placards. In addition, we have found that sales of the article are materially increased by providing the point of purchase display system and device with an improved article display arrangement.

It is, accordingly, an object of the present invention to provide a new and improved point of purchase display system and device.

Another object of the invention is to provide a new and improved point of purchase display system and device having structure for inducing increased sales of articles on the point of purchase display device.

A further object of the invention is to provide a new and improved point of purchase display system and device of the type including elongated members extending from a vertical bearing surface, wherein increased density of articles to be sold and carried by the elongated members is achieved.

SUMMARY OF THE INVENTION

In accordance with the invention, a point of purchase display system includes a device for carrying consumer articles that are for sale and for displaying information about the articles. The articles are physically coupled with a hanger mechanism adapted to be carried by the device. The device comprises at least one and preferably plural elongated elements extending generally parallel to each other. Each element includes a structure enabling the element to be mounted on a vertically extending mounting structure so the elements extend generally at right angles from the mounting structure. In the preferred embodiments, a member fixedly connects adjacent pairs of the elements to each other so the adjacent pairs of the elements are horizontally spaced in approximately the same plane from each other by a predetermined distance determined by the spacing of receptacles for the elements on the mounting structure when the device is mounted on the mounting structure. A placard is positioned at the end of each element removed from the mounting structure and farther from the mounting structure than the articles carried by the element. The placard carries indicia about the article on the mounting structure and a sample of the article in such a manner that the indicia and sample article on the placard are clearly visible without obstruction to purchasers. Preferably, the placard carries an optically transparent seal, e.g. a plastic thermosensitive film, covering the article. In the preferred embodiments the adjacent elements together carry the placard so it spans the distance between the adjacent elements.

Preferably each of the elongated elements includes first and second legs extending generally parallel to each other and arranged when the device is mounted on the mounting structure so the first leg is above the second leg and the end of the first leg extends away from the mounting structure to a greater extent than the end of the second leg. The placard is positioned at the end of the first leg and the hanger mechanism, together with several of the containers and the articles in the containers, are carried by the second leg.

Preferably, in one embodiment the first and second legs are connected together by a bridge carrying a transverse support member for the point of purchase device. The transverse support member is adapted to be carried by a base member including a pair of mounting lugs spaced from each other by the same spacing as a pair of openings in an apertured board of the pegboard type.

In another embodiment wherein the first and second legs are connected together by a bridge carrying a bracket for supporting the point of purchase device, the bracket is adapted to be inserted into a slot of a display board. Two of the brackets are spaced from each other by substantially the same distance as a pair of the slots.

In certain configurations the device includes more than two of the elongated elements and the placard spans across all of the elements.

DETAILED DESCRIPTION OF THE DRAWING

Figure 1:
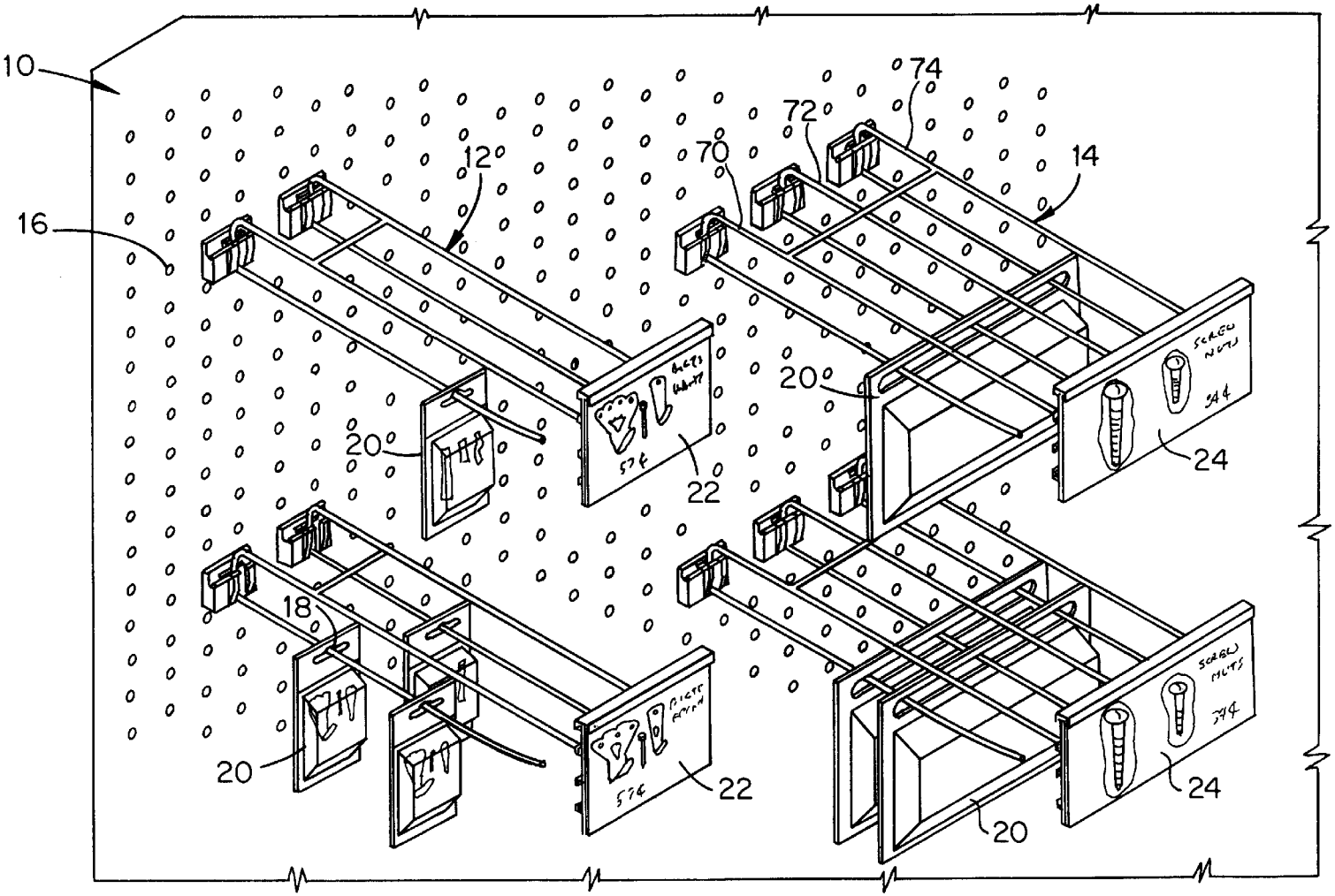
FIG. 1 is a perspective view of a point of purchase display system in accordance with the present invention.
Figures 2, 2A:
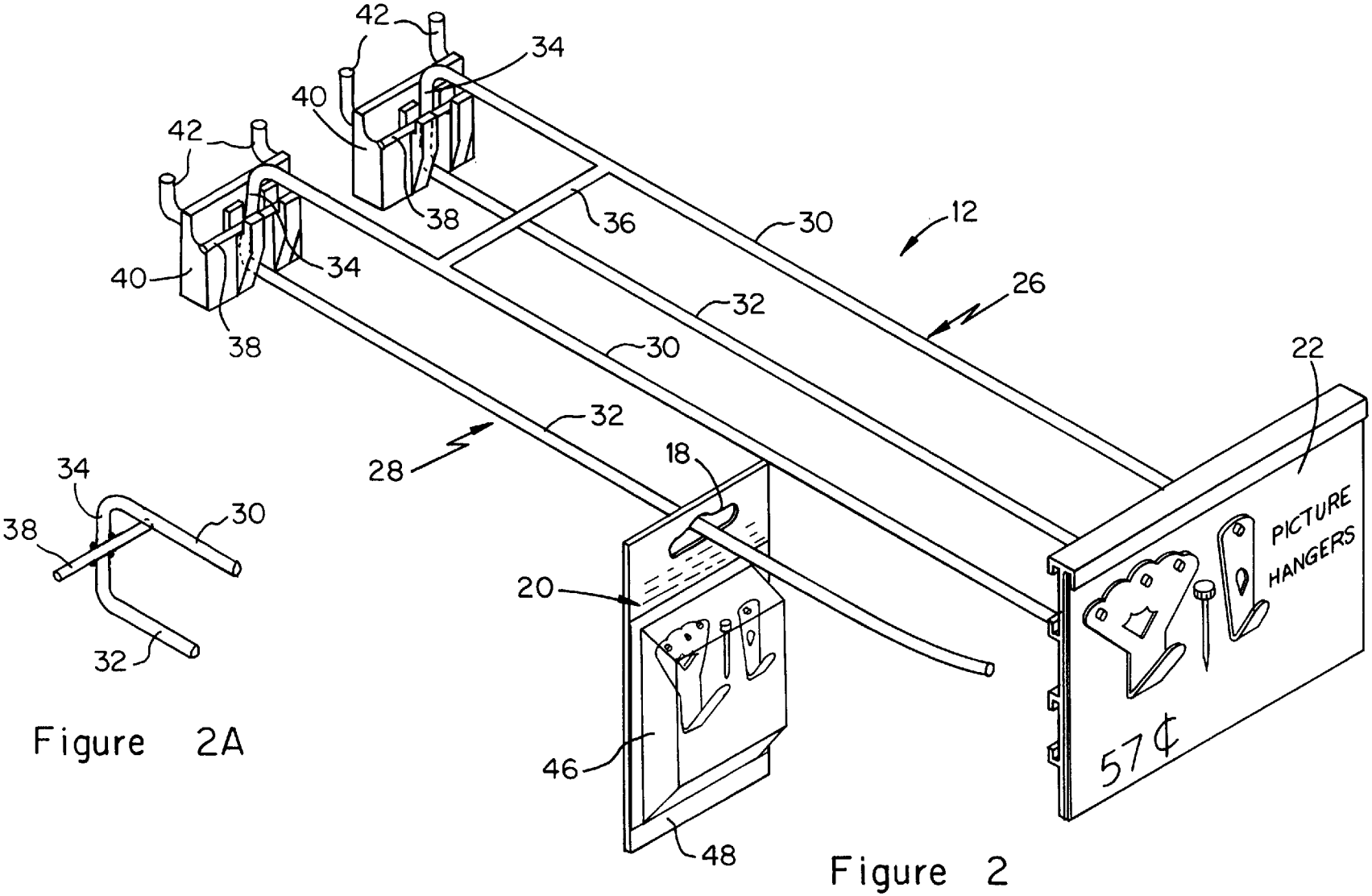
FIG. 2 is a perspective view of a point of purchase display device employed in the system of FIG. 1.
FIG. 2A is a perspective view of a portion of the structure illustrated in FIG. 2.
Figure 3A:
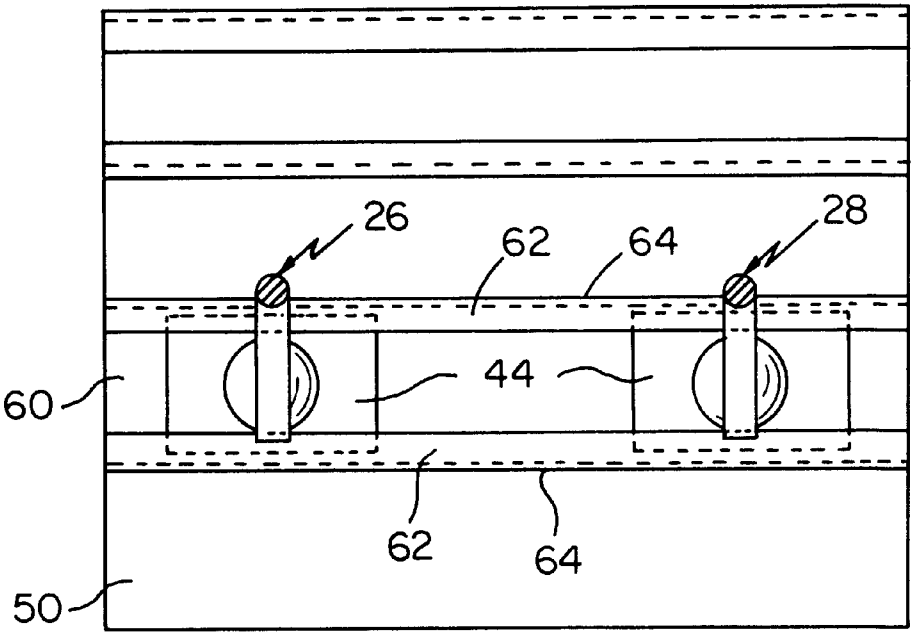
FIG. 3A is a front view of the structure illustrated in FIG. 3A.
Figure 3:
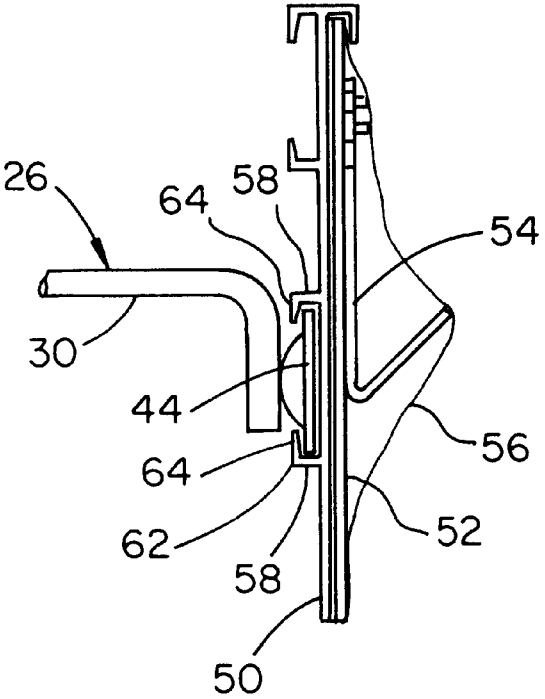
FIG. 3 is a side view of a placard carried by the device of FIG. 2.

The point of purchase display system illustrated in FIGS. 1–3 includes vertically extending, wall mounted apertured or perforated board 10 (commonly known as a pegboard) that is a mounting structure for multiple point of purchase display devices, such as display devices 12 and 14. The display devices generally extend parallel to each other in the vertical and horizontal directions, when mounted on pegboard 10. Pegboard 10 includes multiple circular apertures 16, arranged in a rectangular matrix of rows and columns, and typically having a spacing of about 1" between adjacent apertures. Apertures 16 are receptacles for display devices 12 and 14, each of which can be considered as an elongated element able to receive and carry a plurality of hanger mechanisms 18 on containers 20 for consumer articles to be displayed and sold at point of purchase display system 10. Typically, the consumer articles carried by containers 20 are hardware articles, such as screws, nails, picture hangars, nuts and bolts, and can include larger articles, such as drill bits.

At the forward end of display devices 12 and 14, i.e., the portions of the display devices farthest from pegboard 10, are placards 22 and 24, respectively. Each of placards 22 and 24 includes indicia concerning the article in the container 20 carried by its respective display device.

Each of placards 22 and 24 also carries the same type of article as is in each of the containers (i.e. a sample article) so there is a correspondence between the articles in containers 20 on devices 12 and 14 and the sample articles on placards 22 and 24, respectively. The sample articles are carried by placards 22 and 24 in such a manner that the sample articles are clearly visible, with an unobstructed view by a prospective purchaser. We have found, through actual experimentation and experience, that displaying the sample articles on placards 22 and 24, so the prospective purchaser has an unobstructed view of samples of the articles in the containers on devices 12 and 14, has resulted in significantly increased sales of the articles. In many instances sales of the articles have increased by 200 to 300 percent as a result of displaying the sample articles prominently, without obstruction, at the ends of display devices 12 and 14 remote from pegboard 10. Apparently, the psychological effect of prominently displaying the sample articles at the ends of display devices 12 and 14 remote from pegboard 10 is sufficiently great to induce substantially increased interest and sales of the articles.

Display device 12, illustrated in detail in FIG. 2, includes two generally parallel horizontally extending elements 26 and 28, and formed of a metal rod, bent into a hook. Each of elongated elements 26 and 28 includes upper leg 30, lower leg 32 and bridge 34 connecting the upper and lower legs to each other. Elements 26 and 28 are connected to each other by transversely extending metal strut 36, having its opposite ends welded to upper legs 30 approximately one-third of the way from the bridge 34 on each of elements 26 and 28 to the forward ends of the elements, i.e. the ends of the elements remote from pegboard 10.

Each of elements 26 and 28 carries a transverse support member, in the form of metal crossbar 38 that enables device 12 to be mounted on the mounting structure comprising pegboard 10. Crossbars 38 are welded to the inner faces of bridges 34 and extend generally parallel to strut 36. Crossbars 38 are mounted on molded plastic base members 40, preferably of the type disclosed in U.S. Pat. No. 4,474,351. Each of base members 40 includes two L-shaped lugs 42, having the same spacing from each other as the spacing between adjacent apertures 16 in pegboard 10. Lugs 42 are fitted into apertures 16.

The length of strut 36 and therefore the separation between elements 26 and 28 is such that adjacent lugs 42 on adjacent base members 40 are separated from each other by the same distance as the horizontal spacing between adjacent apertures 16. Since elements 26 and 28 are mounted on the midpoint of crossbars 38, elements 26 and 28 are spaced from each other by approximately 2", which is length of strut 36.

The ends of lower legs 32 remote from pegboard 10 are bent slightly upwardly to facilitate insertion, removal and carrying of containers 20 on legs 32. The ends of upper legs 34 remote from pegboard 10 are bent downwardly and the outer surfaces thereof carry tabs 44, which are welded to the downwardly extending ends of legs 30.

Tabs 44 carry placard 22 so the placard and the sample article and indicia thereon are farther from the mounting structure comprising pegboard 10 than are containers 20 and the articles therein. Thereby, the prospective purchaser can easily ascertain the nature and quality of the article in container 20 from the sample article on display device 12, without having to remove container 20 from lower leg 32. If, however, the prospective purchaser wants to inspect the article in container 20, he/she can easily do so, by removing container 20 from lower leg 32 by slipping hanger 18 over the upwardly extending end of the lower arm remote from pegboard 10. The article is clearly visible, behind plastic, transparent molded window, i.e. shield, 46, adhesively bonded to cardboard base 48 of container 20.

Placard 22 has sufficient area to carry an exact sample of the article in container 20. To this end, placard 22 extends in the horizontal direction through a length slightly less than the distance from the aperture on pegboard 10 that receives outer lug 42 of base 40 carrying element 26 to the outer lug of the base 40 that carries element 28. Hence, the horizontal extent of placard 22 is about 3⅝" to achieve minimum lateral spacing between the vertically extending edges of adjacent placards, e.g. placards 22 and 24. The vertical extent of rectangular placard 22 is such that container 20 can easily be removed from display device 12, without touching placard 22 or the placard on the display device immediately below display device 12. A typical vertical extent of placard 22 is about 2½". Such dimensions for placard 22 enable maximum packing density of display devices 12 and 14, as well as containers 20, on pegboard 10. Hence, the present invention increases the available amount of valuable selling space in a store over the prior art.

As illustrated in FIG. 3, placard 22 includes a hard molded plastic base 50 having a front face to which is adhesively bonded, preferably by glue, cardboard sheet 52. Cardboard sheet 52 has indicia 54 printed on the front face thereof, i.e., the face remote from base 50. The indicia include information about the article in container 20 carried by display device 12. The front face of cardboard sheet 52 also carries sample articles 54, which are the same as the articles in containers 20 on device 12. Sample articles 54 are mounted on and sealingly held in place on the front face of cardboard sheet 52 by optically transparent thermoplastic sheet 56 which is bonded to the cardboard sheet in a conventional manner. Sample articles 54 are mounted behind film 56 in such a manner that samples of all the articles in one of containers 20 on device 12 are clearly visible, without obstruction, to a prospective purchaser of the articles.

The lower portion of plastic molded base 50 includes ears 58 which extend from the back face of the base to form channel 60 that fits into tabs 44 on elements 26 and 28. Each of ears 58 includes flange 62, extending at right angles to base 50, as well as finger 64, connected to flange 62 so it extends parallel to base 50. Channel 60, formed by ears 58, is slid onto tabs 44 of elements 26 and 28 to hold placard 22 securely in place at the end of display device 12.

Display device 14 is generally similar to display device 12, except that display device 14 is particularly adapted to hold larger articles than display device 12. To this end, display device 14 includes three generally parallel, horizontally extending elongated elements 70, 72 and 74, of the same type as elements 26 and 28. Elements 70, 72 and 74 are connected to each other by transverse struts 76 and 78. Display device 14 is particularly adapted to carry relatively lengthy articles, such as drill bits, which are located in sealed containers carried by lower legs 32 of elements 70, 72 and 74. Upper legs 30 of elements 70, 72 and 74 carry tabs 44 for receiving channel 60 of base 50 of placard 24. Placard 24 carries a sample of the same articles that are carried in the sealed containers located on the lower arms 32 of elements 70, 72 and 74 of device 14.

The spacing of adjacent elements 70, 72 and 74 from each other is the same as the spacing of adjacent elements 26 and 28 from each other. However, because three of elements 70, 72 and 74 are included in display device 14, placard 24 has a horizontal extent of about 5", sufficient to carry samples of longer and larger articles. If necessary, more than three elements can be included on a single display device, with corresponding increases in the horizontal extent of the placards associated with such larger display devices.

Figure 4:
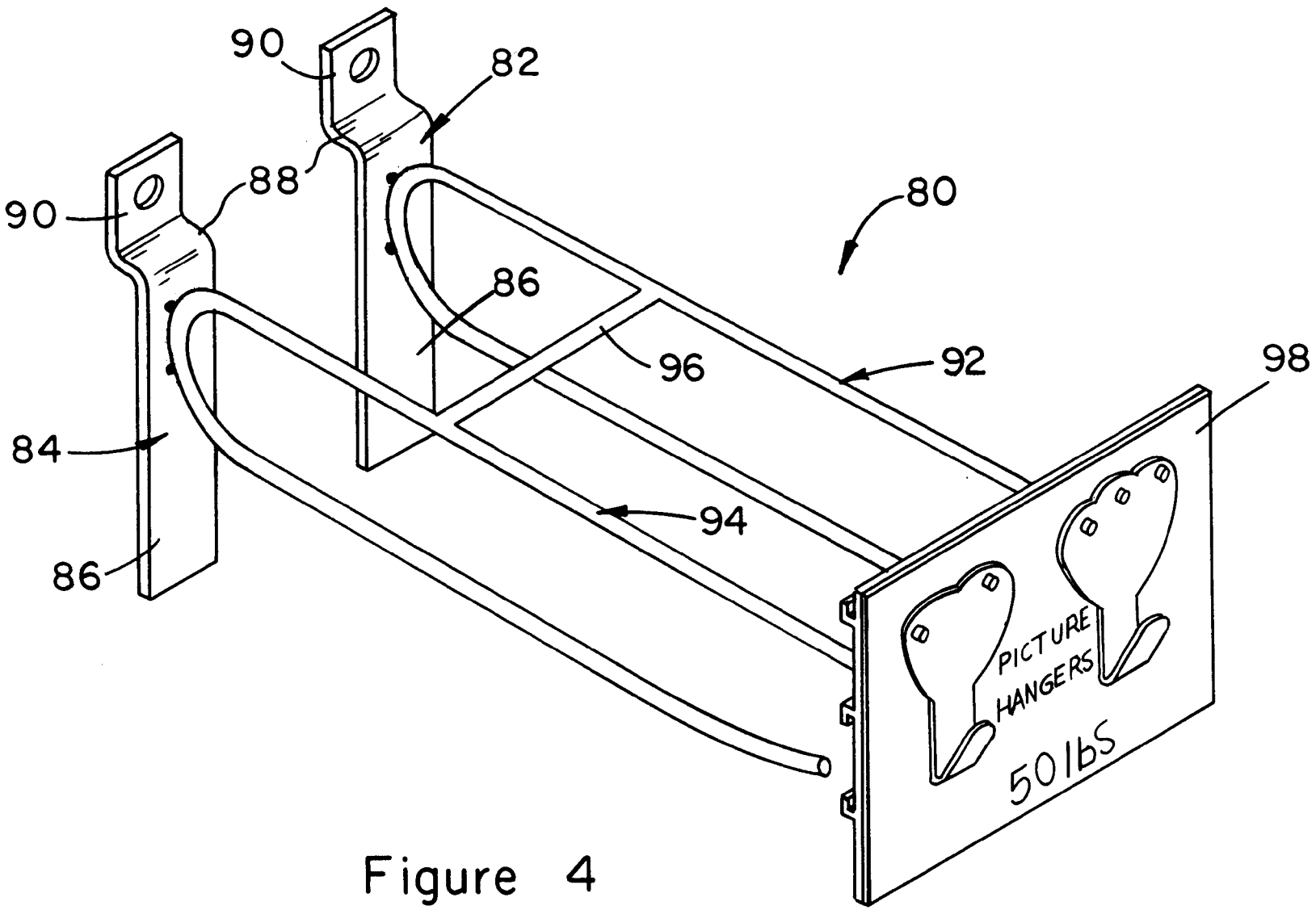
FIG. 4 is a perspective view of a second embodiment of a point of purchase display device in accordance with the invention.

The structure illustrated in FIG. 4 is particularly adapted to be used in combination with a vertically extending slotted wall point of purchase display system that comprises a mounting structure for elongated point of purchase display devices, such as device 80. To insert point of purchase display device 80 into the slotted wall, the device includes a pair of vertically extending spaced brackets 82 and 84, each including elongated vertically extending base portion 86, flange 88 and ear 90. Flanges 88 and ears 90 respectively extend in the horizontal and vertical directions, such that the ears are inserted into the slots in the slotted wall mounting structure and the back faces of base portions 86 bear against the slotted wall exterior face.

Bases 86 of brackets 82 and 84 respectively carry elongated hook elements 92 and 94 which are similar to elongated elements 26 and 28 of the embodiment illustrated in FIGS. 1 and 2. Elongated elements 92 and 94 are connected together by transverse strut 96. The slots in the wall which receive brackets 82 and 84 are spaced such that generally parallel elongated elements 92 and 94 are spaced from each other by about 2", the approximate length of strut 96. The forward ends of the upper legs of members 92 and 94 carry placard 98, constructed in the same manner and having about the same dimensions as placard 22. Thus, placard 98 includes indicia about articles carried by containers 20 slidably inserted onto the lower legs of members 92 and 94. In addition, placard 98 carries samples of the same articles that are in the containers, to provide the advantageous results discussed supra, with regard to displaying the sample article in a prominent position, without obstruction, at the end of display device 80 remote from the slotted wall into which brackets 82 and 84 are inserted.

While there have been described and illustrated several specific embodiments of the invention, it will be clear that variations in the details of the embodiments specifically illustrated and described may be made without departing from the true spirit and scope of the invention as defined in the appended claims.

We claim:

1. A point of purchase system for carrying consumer articles that are for sale and for displaying information about the articles, the articles being physically coupled with a hanger mechanism, the system comprising a vertically extending mounting structure, a plurality of point of purchase devices mounted on said mounting structure, each of said devices including plural elongated elements extending generally parallel to each other, the elements being able to receive and carry a plurality of hanger mechanisms and the articles associated therewith, each element including a structure enabling the element to be mounted on the vertically extending mounting structure so the elements extend generally at right angles from the mounting structure, a member fixedly connecting adjacent pairs of said elements to each other so the adjacent pairs of said elements are horizontally spaced in approximately the same plane from each other by a predetermined distance determined by the spacing of receptacles for the elements on the mounting structure, the adjacent elements together carrying a placard spanning the distance between the adjacent elements, the placard being positioned at ends of the adjacent elements removed from the mounting structure and farther from the mounting structure than the articles carried by the elements, the placard carrying indicia about one of the articles on said mounting structure and a sample of the article in such a manner that said indicia and said sample article are clearly visible without obstructions to purchasers, the sample being essentially the same as the article.

2. The point of purchase system of claim 1 wherein each of the elongated elements includes first and second legs extending generally parallel to each other and arranged when the device is mounted on the mounting structure so the first leg is above the second leg and the end of the first leg extends away from the mounting structure to a greater extent than the end of the second leg, the placard being positioned at the end of the first leg and the hanger mechanism being carried by the second leg.

3. The point of purchase system of claim 2 wherein the first and second legs are connected together by a bridge carrying a transverse support member for the point of purchase device, the transverse support member adapted to be carried by a base member including a pair of mounting lugs spaced from each other by the same spacing as a pair of openings in an apertured display board.

4. The point of purchase system of claim 3 wherein the first and second legs are connected together by a bridge carrying a bracket for supporting the point of purchase device, the bracket adapted to be inserted into a slot of a display board, a pair of the brackets being spaced from each other by substantially the same distance as a pair of the slots.

5. The point of purchase system of claim 2 wherein the number of elongated elements is in excess of two and the placard spans across all the elements, and the sample article has a length equal at least to the span across all the elements.

6. The point of purchase system of claim 1 wherein each of the elements includes a transverse support member for the point of purchase device, the transverse support member adapted to be carried by a base member including a pair of mounting lugs spaced from each other by the same spacing as a pair of openings in an apertured display board.

7. The point of purchase system of claim 1 wherein each of the elements includes a bracket for supporting the point of purchase device, the bracket adapted to be inserted into a slot of a display board, a pair of the brackets being spaced from each other by substantially the same distance as a pair of the slots.

8. The point of purchase system of claim 1 wherein the number of elongated elements is in excess of two and the placard spans across all of the elements, and the sample article has a length equal at least to the span across all the elements.

9. A point of purchase system for carrying consumer articles that are for sale and for displaying information about the articles, the articles being physically coupled with a hanger mechanism, the system comprising a vertically extending mounting structure, a plurality of point of purchase devices mounted on said mounting structure, each of said devices including plural elongated elements extending generally parallel to each other, the elements being able to receive and carry a plurality of hanger mechanisms and the articles associated therewith, each element including a structure enabling the element to be mounted on the vertically extending mounting structure so the elements extend generally at right angles from the mounting structure, a member fixedly connecting adjacent pairs of said elements to each other so the adjacent pairs of said elements are horizontally spaced in approximately the same plane from each other by a predetermined distance determined by the spacing of receptacles for the elements on the mounting structure, the adjacent elements together carrying a placard spanning the distance between the adjacent elements, the placard being positioned at ends of the adjacent elements removed from the mounting structure and farther from the mounting structure than the articles carried by the elements, the placard carrying indicia about one of the articles on said mounting structure and a sample of the article in such a manner that said indicia and said sample article are clearly visible without obstructions to purchasers, the placard carrying an optically transparent seal covering the sample.

10. A point of purchase device for carrying consumer articles that are for sale and for displaying information about the articles, the articles being physically coupled with a hanger mechanism, the device comprising plural elongated elements extending generally parallel to each other, the device comprising plural elongated elements extending generally parallel to each other, the elements being able to receive and carry a plurality of hanger mechanisms and the articles associated therewith, each element including a structure enabling the element to be mounted on a vertically extending mounting structure so the elements extend generally at right angles from the mounting structure, a member fixedly connecting adjacent pairs of said elements to each other so the adjacent pairs of said elements are horizontally spaced in approximately the same plane from each other by a predetermined distance determined by the spacing of receptacles for the elements on the mounting structure when the device is mounted on the mounting structure, the adjacent elements together carrying a placard spanning the distance between the adjacent elements, the placard being positioned at ends of the adjacent elements removed from the mounting structure and farther from the mounting structure than the articles carried by the elements, the placard carrying indicia about one of the articles on said mounting structure and a sample of the article in such a manner that said indicia and said sample article are clearly visible without obstructions to purchasers, the sample being essentially the same as the article.

11. The point of purchase device of claim 10 wherein each of the elongated elements includes first and second legs extending generally parallel to each other and arranged when the device is mounted on the mounting structure so the first leg is above the second leg and the end of the first leg extends away from the mounting structure to a greater extent than the end of the second leg, the placard being positioned at the end of the first leg and the hanger mechanism being carried by the second leg.

12. The point of purchase device of claim 11 wherein the first and second legs are connected together by a bridge carrying a transverse support member for the point of purchase device, the transverse support member adapted to be carried by a base member including a pair of mounting lugs spaced from each other by the same spacing as a pair of openings in an apertured display board.

13. The point of purchase device of claim 11 wherein the first and second legs are connected together by a bridge carrying a bracket for supporting the point of purchase device, the bracket adapted to be inserted into a slot of a display board, a pair of the brackets being spaced from each other by substantially the same distance as a pair of the slots.

14. The point of purchase device of claim 11 wherein the number of elongated elements is in excess of two and the placard spans across all the elements, and the sample article has a length equal at least to the span across all the elements.

15. The point of purchase device of claim 10 wherein each of the elements includes a transverse support member for the point of purchase device, the transverse support member adapted to be carried by a base member including a pair of mounting lugs spaced from each other by the same spacing as a pair of openings in an apertured display board.

16. The point of purchase device of claim 10 wherein each of the elements includes a bracket for supporting the point of purchase device, the bracket adapted to be inserted into a slot of a display board, a pair of the brackets being spaced from each other by substantially the same distance as a pair of the slots.

17. The point of purchase device of claim 10 wherein the number of elongated elements is in excess of two and the placard spans across all of the elements, and the sample article has a length equal at least to the span across all the elements.

18. A point of purchase device for carrying consumer articles that are for sale and for displaying information about the articles, the articles being physically coupled with a hanger mechanism, the device comprising plural elongated elements extending generally parallel to each other, the device comprising plural elongated elements extending generally parallel to each other, the elements being able to receive and carry a plurality of hanger mechanisms and the articles associated therewith, each element including a structure enabling the element to be mounted on a vertically extending mounting structure so the elements extend generally at right angles from the mounting structure, a member fixedly connecting adjacent pairs of said elements to each other so the adjacent pairs of said elements are horizontally spaced in approximately the same plane from each other by a predetermined distance determined by the spacing of receptacles for the elements on the mounting structure when the device is mounted on the mounting structure, the adjacent elements together carrying a placard spanning the distance between the adjacent elements, the placard being positioned at ends of the adjacent elements removed from the mounting structure and farther from the mounting structure than the articles carried by the elements, the placard carrying indicia about one of the articles on said mounting structure and a sample of the article in such a manner that said indicia and said sample article are clearly visible without obstructions to purchasers, the placard carrying an optically transparent seal covering the sample.

19. A point of purchase system for carrying consumer articles that are for sale and for displaying information about the articles, the articles being physically coupled with a hanger mechanism, the system comprising a vertically extending mounting structure, a plurality of point of purchase devices mounted on said mounting structure, each of said devices including an elongated element for receiving and carrying a plurality of hanger mechanisms and the articles associated therewith, each element including a structure enabling the element to be mounted on the vertically extending mounting structure so the elements extend generally at right angles from the mounting structure, a placard positioned at the end of each of the elements removed from the mounting structure and farther from the mounting structure than the articles carried by the elements, the placard fixedly carrying indicia about one of the articles on said mounting structure and a sample of the article in such a manner that said indicia and said sample article are clearly visible without obstructions to purchasers, the sample being essentially the same as the article.

* * * * *